US006206254B1

(12) United States Patent
Lin

(10) Patent No.: US 6,206,254 B1
(45) Date of Patent: Mar. 27, 2001

(54) GARMENT RACK STRUCTURE

(76) Inventor: Jack Lin, No. 3-3, Yun Ho Street, Ta An District Taipei (TW)

( * ) Notice: Subject to any disclaimer, the term of this patent is extended or adjusted under 35 U.S.C. 154(b) by 0 days.

(21) Appl. No.: 09/323,891

(22) Filed: Jun. 2, 1999

(51) Int. Cl.[7] ..... A47G 25/40
(52) U.S. Cl. ..... 223/94; 223/90; 223/89
(58) Field of Search ..... 223/85, 88, 92, 223/94, 89, 90

(56) References Cited

U.S. PATENT DOCUMENTS 2,504,562 * 4/1950 Melcher ..... 223/89
2,513,980 * 7/1950 Widmann ..... 223/89
2,527,312 * 10/1950 Kenworthy ..... 223/89
2,791,361 * 5/1957 Gross ..... 223/94
3,443,729 * 5/1969 Hannum ..... 223/94
5,085,357 * 2/1992 Chen ..... 223/89

* cited by examiner

*Primary Examiner*—Bibhu Mohanty
(74) *Attorney, Agent, or Firm*—Bacon & Thomas. PLLC

(57) ABSTRACT

A garment rack structure including a hanging hook, a locking bar, two movable plates, two transverse beams, a locating screw and two support frames. The garment rack can be conveniently used to suitably hang various sizes of clothes thereon. The width of the garment rack can be quickly adjusted in accordance with the size of the clothes. The bottoms of the support frames are disposed with sleeves in which transverse beams are fitted. Two extension arms are disposed at two ends of the support frames for elongating the length of the garment rack.

6 Claims, 7 Drawing Sheets

GARMENT RACK STRUCTURE

BACKGROUND OF THE INVENTION

The present invention relates to a garment rack structure which can be conveniently used to suitably hang various sizes of clothes thereon without damaging the clothes.

A conventional garment rack is made of an iron wire with fixed size. As shown in FIGS. 1 and 2. Such conventional garment rack has some shortcomings as follows:

1. The garments have different sizes so that the conventional garment rack is often too large or too small for the garment hung thereon.
2. The conventional garment rack is made of an iron wire simply by bending the iron wire or made by molding. However, the sizes of the garments varies with the configuration of the users or the different seasons, while the shoulder width of the conventional garment rack cannot be adjusted. Therefore, the conventional garment rack often fails to well support and store the garment.
3. In the case that the width of the garment is larger than that of the garment rack, after a certain period of hanging, the shoulder portions of the garment will be formed with two protuberances. Especially, with respect to a cotton-made clothes or just washed clothes, after dried in the air or insolated, the protuberances will be very apparent. This leads to a poor appearance.
4. There is buckle-type garment rack on market. The side frame of such garment rack is widened and clothes clips are added to the transverse beam of the garment rack. Accordingly, a clothes can be better hung on the garment rack and the function of the garment rack is enhanced. However, such garment rack still only provides a fixed size for the clothes to hang thereon and fails to achieve an adjustment function in accordance with the varied sizes of different clothes.
5. The clothes clips added to the transverse beam of the garment rack serve to clip the clothes. However, in the case that the clothes are too heavy to clip or the clips are subject to elastic failure after a long period of use, the clips will lose their fixing function.

SUMMARY OF THE INVENTION

It is therefore a primary object of the present invention to provide a garment rack structure including a hanging hook, a locking bar, two movable plates, two transverse beams, a locating screw and two support frames. The garment rack can be conveniently used to suitably hang various sizes of clothes thereon. The width of the garment rack can be quickly adjusted in accordance with the size of the clothes.

The garment rack of the present invention has the following advantages:

1. The width of the garment rack can be quickly adjusted and fixed in accordance with the size of the clothes.
2. The garment rack is made of integral injection molding. Such manufacturing method will not lead to unstable condition due to adjustment function. The conventional adjustable garment rack is adjusted one side by one side. Such procedure is time-consuming and after adjusted, the two sides may have different lengths. This will lead to tilting of the garment rack in use.
3. The garment rack is disposed with a locating screw for adjustably fixing the transverse beam at a certain width in accordance with the size of the clothes. Therefore, the garment rack can be widely used by various people including those with special body configuration. Therefore, it is no more necessary to manufacture a custom garment rack or purchase different sizes of garment racks for different uses.
4. The transverse beam is fitted in the sleeve which is disposed under the bottom of the support frame. A locating screw is disposed on the sleeve. The locating screw serves to fix the transverse beam at a certain position in the sleeve. One end of the transverse beam is fixed in a sleeve, while the other end thereof is fitted in an opposite sleeve. Therefore, the width of the garment rack can be freely adjusted in accordance with the sizes of various clothes and the problem of protuberances on shoulder portions is eliminated.
5. Two ends of the support frame are disposed with extension arms for adjusting the length of the garment rack to hang thereon a larger clothes such as a sport player's clothes.
6. The clothes clips are hung on the sleeve and equipped with restricting screws for fixing the clips as necessary so as to avoid loosening or dropping of the clothes from the clothes clips.

The present invention can be best understood through the following description and accompanying drawings wherein:

DETAILED DESCRIPTION OF THE PREFERRED EMBODIMENTS

Figure 1:
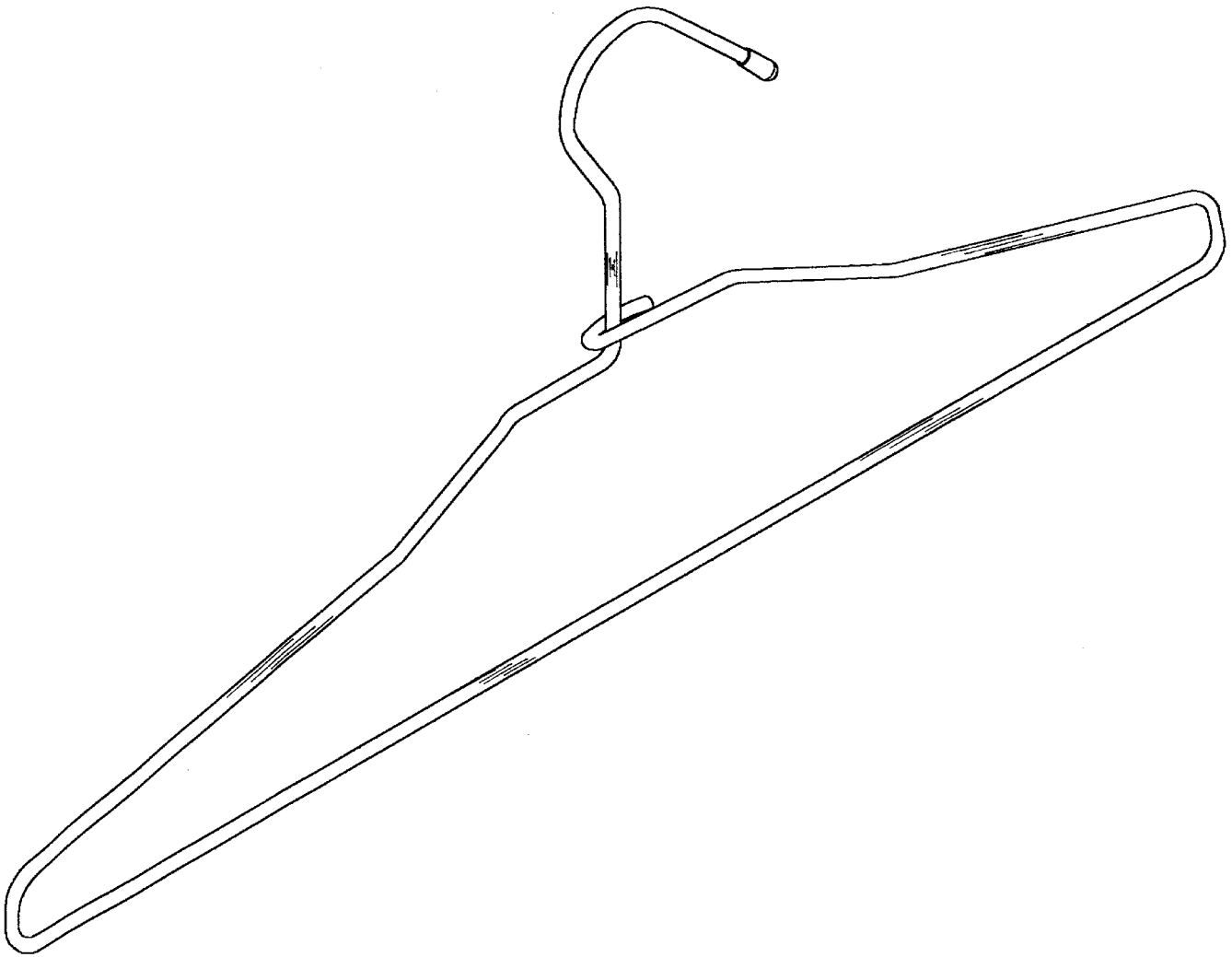
FIG. 1 is a perspective view of a conventional garment rack.
Figure 2:
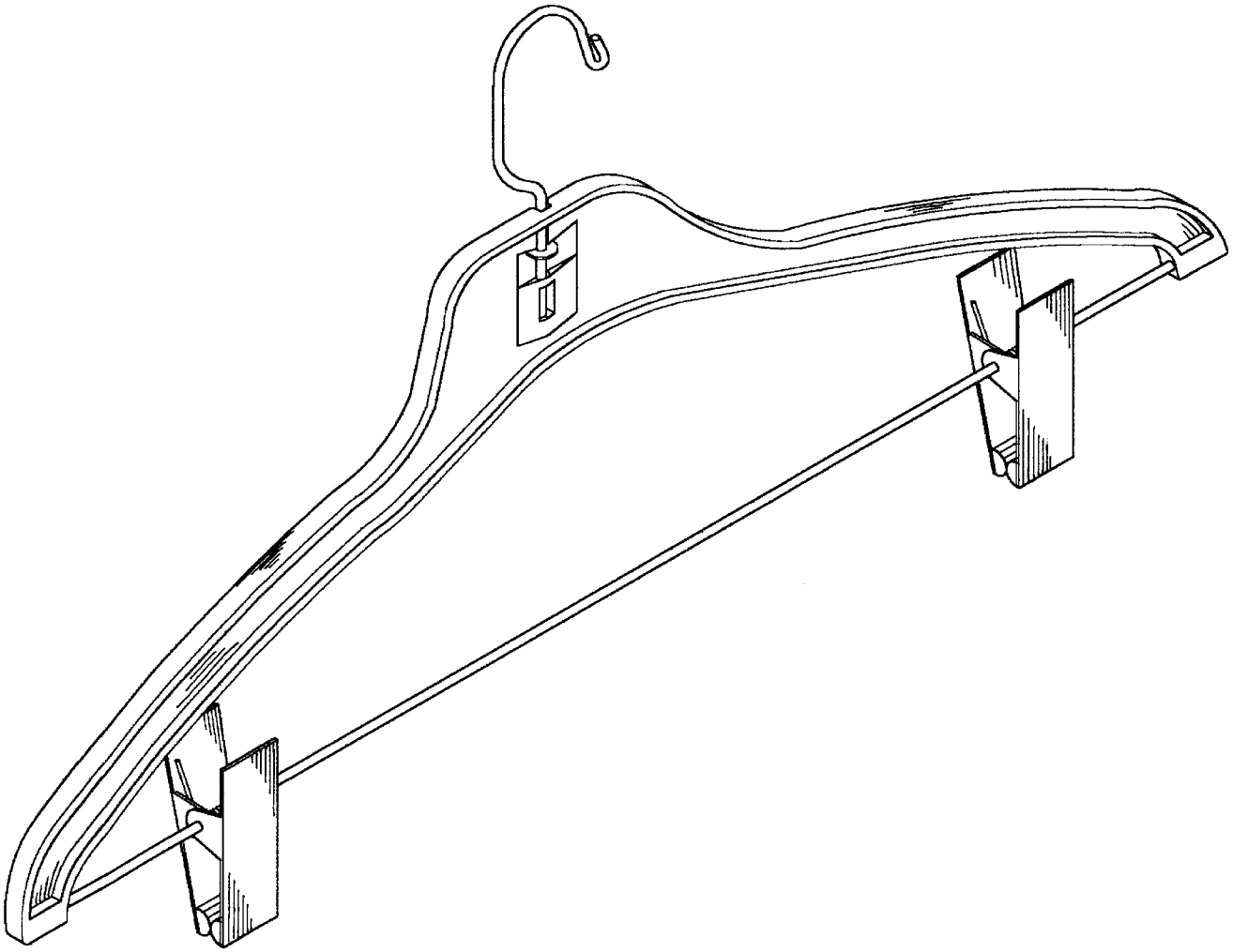
FIG. 2 is a perspective view of another conventional garment rack.
Figure 3:
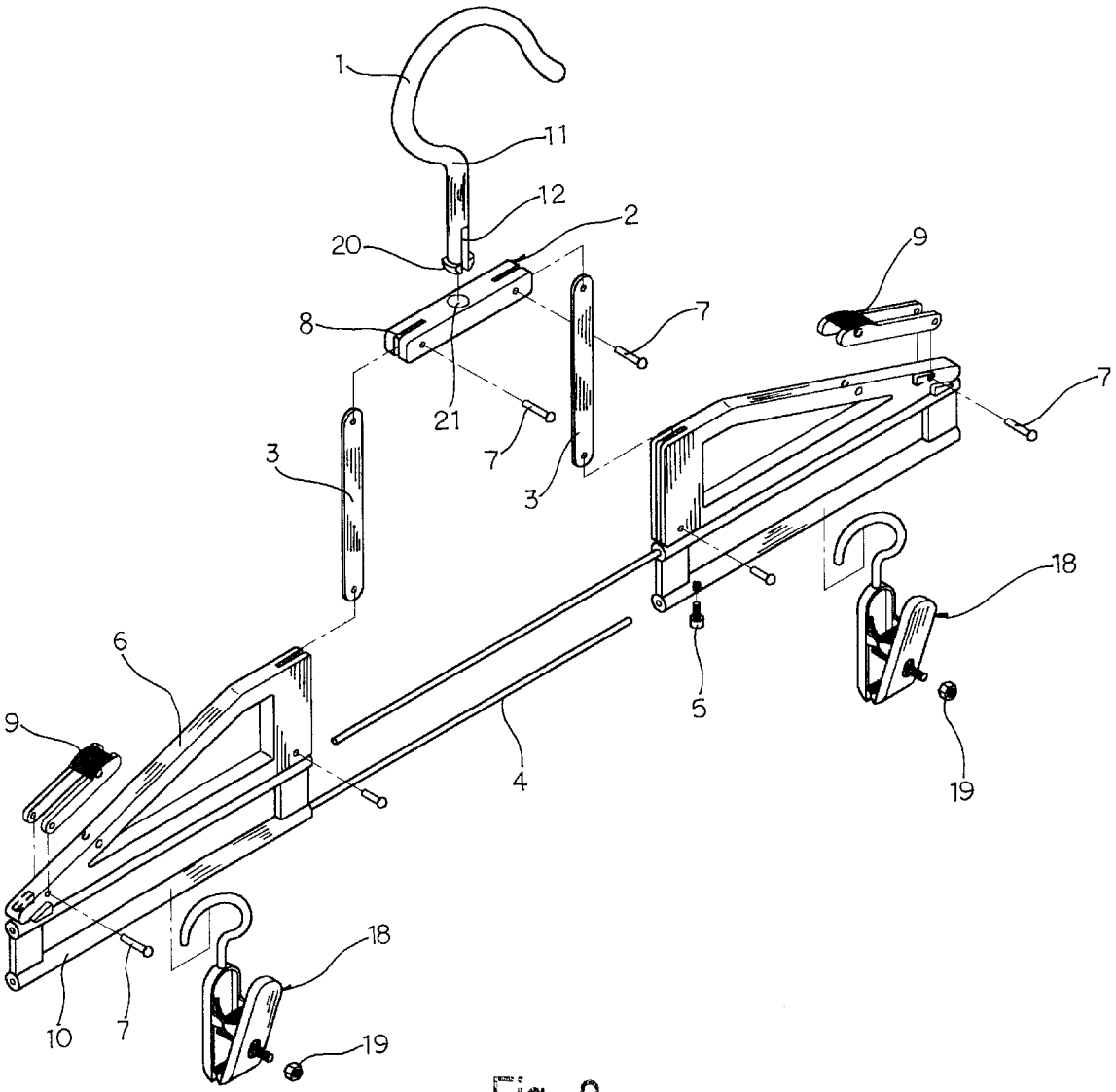
FIG. 3 is a perspective exploded view of the garment rack of the present invention.
Figure 4:
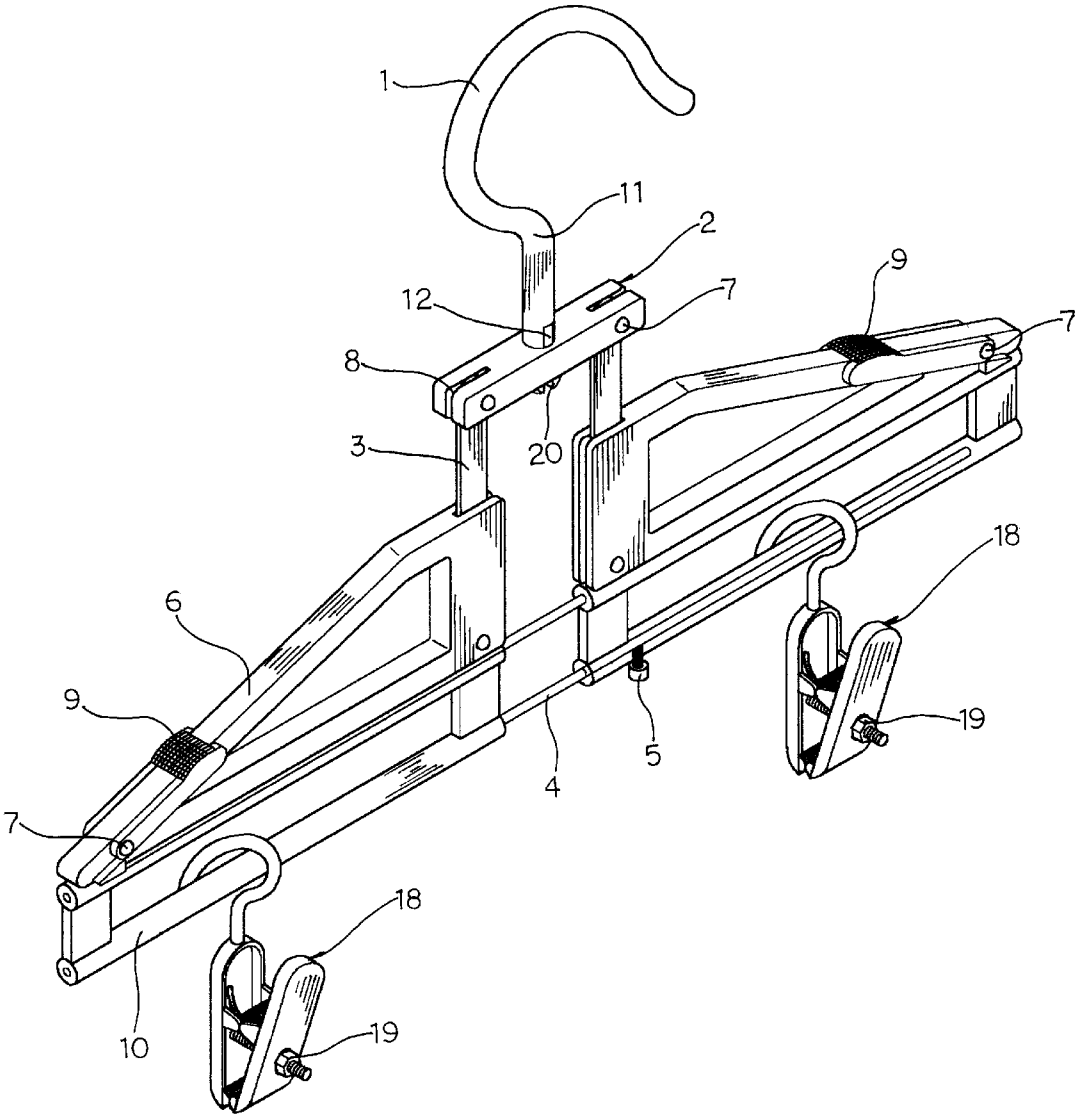
FIG. 4 is a perspective assembled view of the garment rack of the present invention.

Please refer to FIGS. 3 and 4. The garment rack of the present invention includes a hanging hook 1, a locking bar 2, two movable plates 3, two transverse beams 4, a locating screw 5, two support frames 6 and clothes clips 18.

The hanging hook 1 is disposed with a stem 11 at bottom end. The stem 11 is formed with a central fissure 12 dividing the stem 11 into two halves. The lower end of the stem 11 is disposed with a reverse hook section 20 for avoiding detachment.

The locking bar 2 is a rectangular body formed with a central insertion hole 21 with a diameter equal to that of the stem 11 of the hanging hook 1 for inserting therewith. Two ends of the locking bar 2 are formed with slits 8 for the movable plates 3 to connect with the locking bar 2 by rivets 7.

The two movable plates 3 are symmetrically disposed in the recesses of the two support frames 6 and the slits 8 of the locking bar 2 and locked by rivets 7, whereby the movable plates 3 can be swung left and right.

One end of the transverse beam 4 is fixed in a sleeve 10, while the other end thereof is fitted in an opposite sleeve 10. The two transverse beams are parallel to each other to achieve a symmetrically balancing effect and free adjustment function.

The locating screw 5 is disposed on the sleeve 10 near the center thereof, serving to fix the transverse beam 4 and the length of the garment rack for suitably hanging a garment thereon.

The support frame 6 is a right triangular frame. The two support frames 6 are symmetrically disposed with their right angle sides inserted with the movable plates 3 and movably fixed by rivets 7. Two ends of the support frame 6 are disposed with extension arms 9 for hanging thereon a garment with wider width.

The clothes clip 18 is equipped with a restricting screw 19 for enhancing the clipping force of the clothes clip 18 without loosening or dropping of the clothes.

Figure 5:
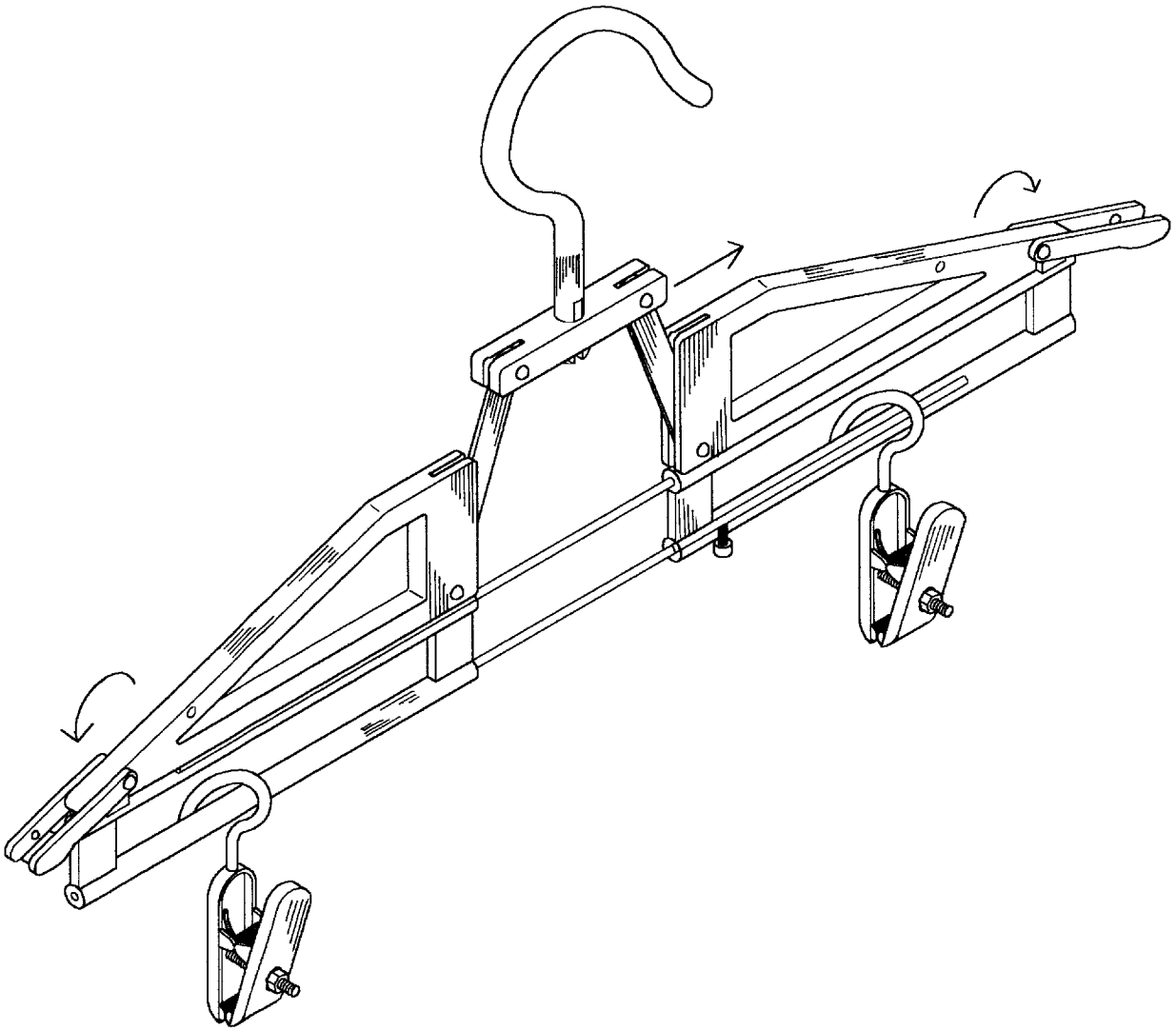
FIG. 5 shows the operation of the garment rack of the present invention.

FIG. 5 shows the operation of the present invention. By means of the locking bar 2, movable plates 3, transverse beams 4, locating screw 5 and support frames 6, the garment rack of the present invention can be adjusted in width for different sizes of clothes to hang thereon.

Figure 6:
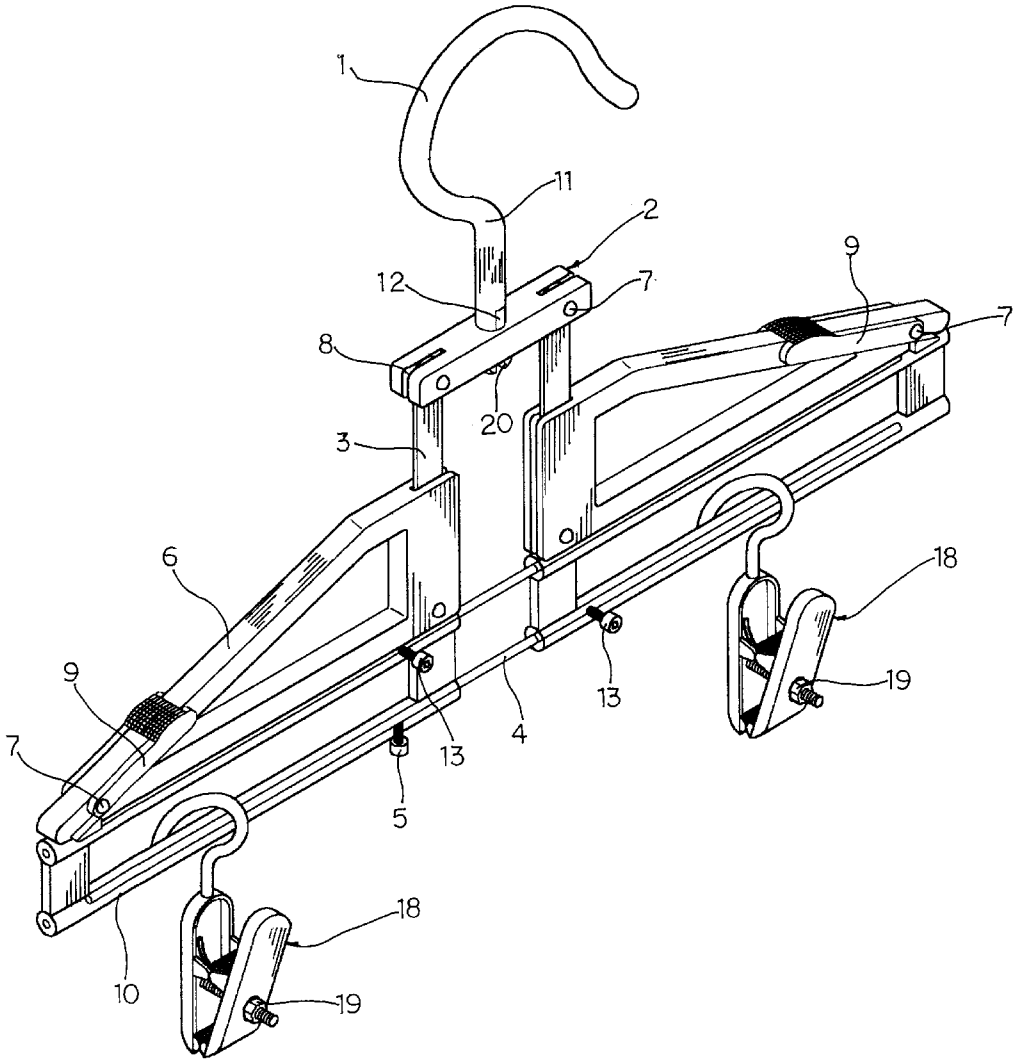
FIG. 6 is a perspective assembled view of another embodiment of the garment rack of the present invention.
Figure 7:
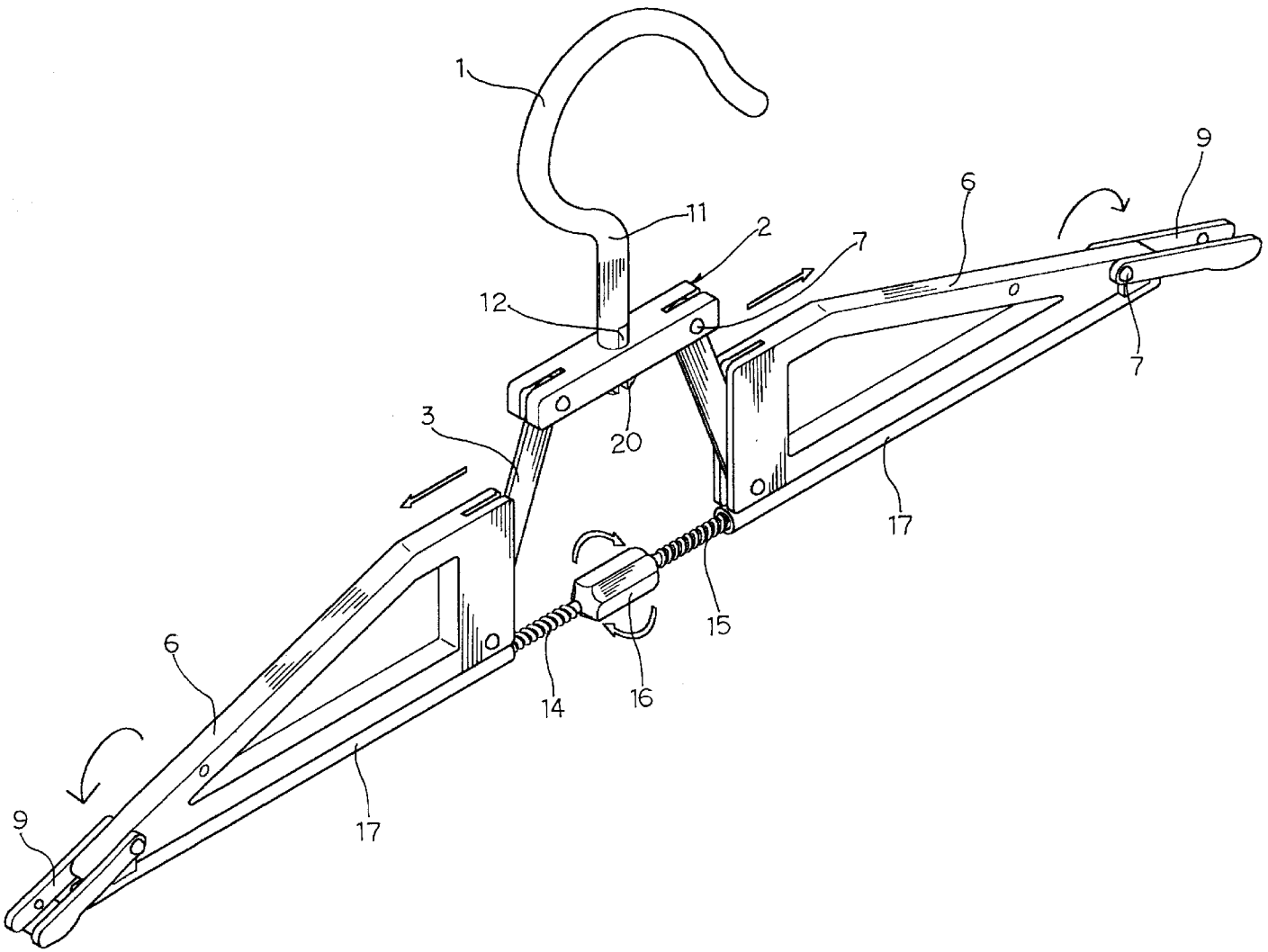
FIG. 7 is a perspective assembled view of still another embodiment of the garment rack of the present invention.

FIG. 6 shows another embodiment of the present invention. An adjustment screw 13 and a locating screw 5 are disposed on the sleeve 10 at opposite angles for fixing the transverse beams at a certain position in the sleeve 10 so as to adjust the width of the garment rack in accordance with the size of the clothes. FIG. 7 shows still another embodiment of the present invention. The bottom faces of the two support frames 6 are respectively disposed with thread sleeves 17. A male thread rod 14 and a female thread rod 15 are respectively connected to two ends of the thread sleeves 17. The male and female thread rods 14, 15 are respectively formed with forward and backward threads. The center of the male and female thread rods 14, 15 is disposed with a modulation section 16 interconnecting the male and female thread rods 14, 15 for adjusting the length of the garment rack.

When assembled, the upper and lower transverse beams 4 are parallelly fitted into the corresponding sleeves 10. Then the hanging hook 1 is inserted into the locking bar 2. The movable plates 3 are respectively locked in the slits 8 of the locking bar 2 and the recesses of the support frames 6. Alternatively, the hanging hook 1 is first inserted into the locking bar 2 and then the movable plates 3 are locked in two ends of the locking bar 2. The transverse beams 4 are fitted into the sleeves 10 and the locating screw 5 is screwed into the sleeve 10 for left and right movably fixing the transverse beam 4. The hanging hook 1 is disposed with a stem 11 at bottom end. The stem 11 is formed with a central fissure 12 dividing the stem 11 into two halves. The lower end of the stem 11 is disposed with a reverse hook section 20 for avoiding detachment. By means of the reverse hook section 20, the hanging hook 1 can be firmly fixed on the locking bar 2 as shown in FIG. 6.

The above embodiments are only used to illustrate the present invention, not intended to limit the scope thereof. Many modifications of the above embodiments can be made without departing from the spirit of the present invention.

What is claimed is:

1. A garment rack structure comprising a hanging hook, a locking bar, two movable plates, two transverse beams, a locating screw, two support frames and clothes clips, wherein:

the hanging hook is disposed with a stem at bottom end, the stem being formed with a central fissure dividing the stem into two halves, a lower end of the stem being disposed with a reverse hook section for avoiding detachment;

the locking bar is a rectangular body inserting with the hanging hook at a central section, two ends of the locking bar being formed with slits for the movable plates to connect with the locking bar by rivets;

the two movable plates are symmetrically disposed in the recesses of the two support frames and the slits of the locking bar and locked by rivets, whereby the movable plates can be swung left and right;

one end of the transverse beam is fixed in a sleeve, while the other end thereof is fitted in an opposite sleeve, the two transverse beams being parallel to each other to achieve a free adjustment function;

the locating screw is disposed on the sleeve near the center thereof, serving to fix the transverse beam and the length of the garment rack;

each support frame is a right triangular frame, the two support frames being symmetrically disposed with their right angle sides inserted with the movable plates and movably fixed by rivets, two ends of the support frame being disposed with extension arms for hanging thereon a garment with wider width; and each clothes clip is equipped with a restricting screw for enhancing the clipping force of the clothes clip without loosening or dropping of the clothes.

2. A garment rack structure as claimed in claim 1, wherein the locating screw is disposed on the sleeve near the center thereof, serving to fix the transverse beam, whereby the transverse beams can be moved left and right or one transverse beam is moved, while the other is not moved.

3. A garment rack structure as claimed in claim 1, wherein the support frame is made by integral injection molding.

4. A garment rack structure as claimed in claim 1, wherein the transverse beam is fitted in the sleeve and adjustment screws and a locating screw are disposed on the sleeve, the adjustment screws being disposed at opposite angles for fixing the transverse beams at a certain position in the sleeve so as to adjust the width of the garment rack in accordance with the size of the clothes.

5. A garment rack structure as claimed in claim 1, wherein bottom faces of the two support frames are respectively disposed with locating thread sleeves, a male thread rod and a female thread rod being respectively screwed in the locating thread sleeves, the male and female thread rods being respectively formed with forward and backward threads, the center of the male and female thread rods being disposed with a modulation section interconnecting the male and female thread rods for adjusting the length of the garment rack.

6. A garment rack structure as claimed in claim 1, wherein two ends of the support frames are disposed with extension arms for elongating the length of the garment rack.

* * * * *